US009646541B2

(12) United States Patent
Kim

(10) Patent No.: US 9,646,541 B2
(45) Date of Patent: May 9, 2017

(54) DISPLAY DEVICE

(71) Applicant: Samsung Display Co., Ltd., Yongin, Gyeonggi-Do (KR)

(72) Inventor: Mi Hae Kim, Asan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/558,463

(22) Filed: Dec. 2, 2014

(65) Prior Publication Data

US 2016/0005346 A1 Jan. 7, 2016

(30) Foreign Application Priority Data

Jul. 7, 2014 (KR) ..... 10-2014-0084663

(51) Int. Cl.
*G09G 3/3266* (2016.01)

(52) U.S. Cl.
CPC ... *G09G 3/3266* (2013.01); *G09G 2310/0286* (2013.01)

(58) Field of Classification Search
CPC ..... G09G 3/3677; G09G 3/2014
USPC ..... 257/204, 690
See application file for complete search history.

(56) References Cited

U.S. PATENT DOCUMENTS

| | | | | |
|---|---|---|---|---|
| 9,218,764 | B2 * | 12/2015 | Yoon | G09G 3/3225 |
| 2006/0145998 | A1 * | 7/2006 | Cho | G09G 3/3677 345/100 |
| 2009/0184984 | A1 * | 7/2009 | Takahara | G09G 3/2014 345/690 |
| 2010/0007635 | A1 * | 1/2010 | Kwon | G09G 3/3677 345/204 |
| 2010/0039423 | A1 | 2/2010 | Jeong et al. | |

FOREIGN PATENT DOCUMENTS

| | | | |
|---|---|---|---|
| KR | 10-2008-0027746 | A | 3/2008 |
| KR | 10-2010-0081481 | A | 7/2010 |
| KR | 10-2012-0060612 | A | 6/2012 |

* cited by examiner

*Primary Examiner* — Tan N Tran
(74) *Attorney, Agent, or Firm* — Knobbe Martens Olson & Bear LLP

(57) ABSTRACT

A display device is disclosed. In one aspect, the display device includes a display panel including gate lines and pixels electrically connected to the gate lines, the pixels comprising a first pixel row and a second pixel row having a fewer number of pixels than the first pixel row. The display device also includes a gate driver including stages, each configured to output a gate signal to the respective gate line, the gate lines comprising first and second gate lines respectively connected to the first and second pixel rows, and the stages comprising first and second stages respectively connected to the first and second gate lines. An output transistor of each stage is configured to output the gate signal and the channel width of the output transistor of the first stage is greater than that of the output transistor of the second stage.

16 Claims, 7 Drawing Sheets

DISPLAY DEVICE

CROSS-REFERENCE TO RELATED APPLICATION

This application claims priority to and the benefit of Korean Patent Application No. 10-2014-0084663 filed in the Korean Intellectual Property Office on Jul. 7, 2014, the entire contents of which are incorporated herein by reference.

BACKGROUND

Field

The described technology generally relates to a display device.

Description of the Related Technology

Currently, flat panel displays (FPDs) such as liquid crystal displays (LCDs), organic light-emitting diode (OLED) displays, electrophoretic displays (EPDs), etc. are being widely used.

In FPDs, a plurality of pixels are arranged in a matrix form, and a gate line and a data line are electrically connected to each pixel. The gate line is electrically connected to a gate driver to be applied with a gate signal, and the data line is electrically connected to a data driver to be applied with a data signal. Thus, the pixels are selectively applied with the data signals to display an image.

Generally, an equal number of pixels are electrically connected to each of the gate lines in the FPDs described above. Accordingly, pixel loads of the respective gate lines are the same and thus stage circuits of the gate driver for applying gate signals to the respective gate lines are designed such that they have the same buffer size.

SUMMARY OF CERTAIN INVENTIVE ASPECTS

One inventive aspect is a display device with superior display quality.

Another aspect is a display device including pixel arrays having different pixel loads to improve a luminance deviation between the pixel arrays.

Another aspect is a display device including a display panel including a plurality of gate lines and a plurality of pixels that are electrically connected to the plurality of gate lines, and a first pixel row including a p number of pixels and a second pixel row including a q number of pixels that is less than the p number of pixels; and a gate driver including a plurality of stages for outputting a gate signal to the plurality of gate lines. Each stage includes an output transistor that is electrically connected between an input terminal of a clock signal and an output terminal of a stage and outputs the gate signal, and a channel width of an output transistor of a stage electrically connected to a gate line of the first pixel row is greater than that of an output transistor of a stage electrically connected to a gate line of the second pixel row.

The output transistor can include an input terminal electrically connected to a second clock signal input terminal, an output terminal electrically connected to an output terminal of the stage, and a control terminal electrically connected to a J2 node.

A difference between channel widths of the output transistors can be configured to have a value for reducing a deviation between characteristics of a gate signal applied to the first pixel row and characteristics of a gate signal applied to the second pixel row.

The characteristics of the gate signal can be a falling time and a rising time of a gate-on voltage.

A start pulse vertical signal or previous stage output signal, first and second clock signals, and first and second power supply voltages can be input to the respective stages.

The first and second clock signals can have waveforms that are sequentially delayed in phase.

Each stage can include a J1 node and a J2 node, and a voltage level controller for controlling voltage levels of the J1 node and J2 node to have high and low levels.

The voltage level controller can include T1, T2, T3, and T4 transistors.

The T1 transistor can be electrically connected between an input terminal of the start pulse vertical signal or previous stage output signal and the J2 node.

The T2 transistor can be electrically connected between the first power supply voltage and the T3 transistor.

The T3 transistor can be electrically connected between the T2 transistor and the J2 node.

The T4 transistor can be electrically connected between the J1 node and a first clock signal input terminal.

Control terminals of the T1, T2, T3, and T4 transistors can be respectively electrically connected to the first clock signal input terminal, the J1 node, the second clock signal input terminal, and the J2 node.

Each stage can include a T5 transistor, which is electrically connected between a second power supply voltage and the J1 node with its control terminal electrically connected to a first clock signal input terminal.

Each stage can include a T6 transistor, which is electrically connected between a first power supply voltage and an output terminal of the stage with its control terminal electrically connected to the J1 terminal.

Each stage can include a first capacitor that is electrically connected between the J2 node and the output terminal of the stage.

Each stage can include a second capacitor that is electrically connected between the J1 node and the first power supply voltage.

The display panel or a display area of the display panel can have shapes other than a quadrangular shape, and the display panel or the display area thereof can substantially have a circular or oval shape.

The gate driver can be integrated into the display panel.

Another aspect is display device comprising a display panel including a plurality of gate lines and a plurality of pixels electrically connected to the gate lines, wherein the pixels comprise a first pixel row and a second pixel row having a fewer number of pixels than the first pixel row. The display device also comprises a gate driver including a plurality of stages each configured to output a gate signal to the respective gate line, wherein the gate lines comprise first and second gate lines respectively connected to the first and second pixel rows, wherein the stages comprise first and second stages respectively connected to the first and second gate lines, wherein each stage includes an output transistor electrically connected between an input terminal of a clock signal and an output terminal of the stage, wherein the output transistor is configured to output the gate signal, and wherein the channel width of the output transistor of the first stage is greater than that of the output transistor of the second stage.

In the above display device, the output transistor includes an input terminal electrically connected to a second clock signal input terminal, an output terminal electrically connected to an output terminal of the stage, and a control terminal electrically connected to a first node.

In the above display device, the difference between the channel widths of the output transistors corresponds to a value configured to reduce a deviation between characteristics of a gate signal applied to the first pixel row and characteristics of a gate signal applied to the second pixel row.

In the above display device, the characteristics of the gate signal include a falling time and a rising time of a gate-on voltage.

In the above display device, each of stages is configured to receive a start pulse vertical signal or a previous stage output signal, first and second clock signals, and first and second power supply voltages.

In the above display device, the first and second clock signals have waveforms that are sequentially delayed in phase.

In the above display device, each stage further includes a first and second nodes and a voltage level controller configured to control voltage levels of the first and second nodes to have high and low levels.

In the above display device, the voltage level controller includes T1, T2, T3, and T4 transistors, the T1 transistor is electrically connected between an input terminal of the start pulse vertical signal or a previous stage output signal and the first node, the T2 transistor is electrically connected between the first power supply voltage and the T3 transistor, the T3 transistor is electrically connected between the T2 transistor and the first node, the T4 transistor is electrically connected between the second node and a first clock signal input terminal, and control terminals of the T1, T2, T3, and T4 transistors are respectively electrically connected to the first clock signal input terminal, the second node, the second clock signal input terminal, and the first node.

In the above display device, each stage further includes a T5 transistor, which is electrically connected between a second power supply voltage and the second node with its control terminal electrically connected to a first clock signal input terminal.

In the above display device, each stage further includes a T6 transistor, which is electrically connected between a first power supply voltage and an output terminal of the stage with its control terminal electrically connected to the second terminal.

In the above display device, each stage further includes a first capacitor that is electrically connected between the first node and the output terminal of the stage.

In the above display device, each stage further includes a second capacitor that is electrically connected between the second node and the first power supply voltage.

In the above display device, the display panel or a display area of the display panel has a non-quadrangular shape.

In the above display device, the display panel or the display area thereof is substantially circular or oval.

In the above display device, the gate driver is integrated into the display panel.

Another aspect is a display device comprising a display panel including a plurality of gate lines and a plurality of pixels electrically connected to the gate lines. The display device also comprises a gate driver including a plurality of stages each including an output transistor configured to output a gate signal to the respective gate line, wherein the stages comprise first and second stages, and wherein the channel widths of the output transistors of the first and second stages are different.

In the above display device, the pixels comprise a first pixel row and a second pixel row having a fewer number of pixels than the first pixel row.

In the above display device, the output transistor of the first stage is greater than that of the output transistor of the second stage.

In the above display device, the output transistor of each stage is electrically connected between an input terminal of a clock signal and an output terminal of the stage, wherein the output transistor includes an input terminal electrically connected to a second clock signal input terminal, an output terminal electrically connected to an output terminal of the stage, and a control terminal electrically connected to a first node.

In the above display device, the difference between the channel widths of the output transistors corresponds to a value configured to reduce a deviation between characteristics of the gate signal applied to the first stage and characteristics of the gate signal applied to the second stage, wherein the characteristics of the gate signal include a falling time and a rising time of a gate-on voltage.

According to at least one of the disclosed embodiments, a display device with superior display quality can be provided. By differently designing buffer sizes of the stages of the gate driver electrically connected to the pixel arrays having the different pixel loads through the gate lines, deviations of waveforms of a gate signal applied to these pixel arrays can be reduced, thereby reducing or eliminating a luminance difference between the pixel arrays.

DETAILED DESCRIPTION OF CERTAIN INVENTIVE EMBODIMENTS

The described technology will be described more fully hereinafter with reference to the accompanying drawings, in which exemplary embodiments are shown.

As those skilled in the art would realize, the described embodiments can be modified in various different ways, all without departing from the spirit or scope of the described technology.

Throughout the specification, when it is described that an element is "electrically connected" to another element, the element can be "directly electrically connected" to the other element or "electrically connected" to the other element through a third element. In addition, unless explicitly described to the contrary, the word "comprise" and variations such as "comprises" or "comprising" will be understood to imply the inclusion of stated elements but not the exclusion of any other elements. In this disclosure, the term "substantially" includes the meanings of completely, almost completely or to any significant degree under some applications and in accordance with those skilled in the art.

Moreover, "formed on" can also mean "formed over." The term "connected" can include an electrical connection.

A display device according to an exemplary embodiment will now be described in detail with reference to the drawings. Hereafter, even if an organic light-emitting diode (OLED) display is exemplarily described, the described technology can be applicable to other display devices such as liquid crystal displays (LCDs) and electrophoretic displays (EPDs).

Figure 1:
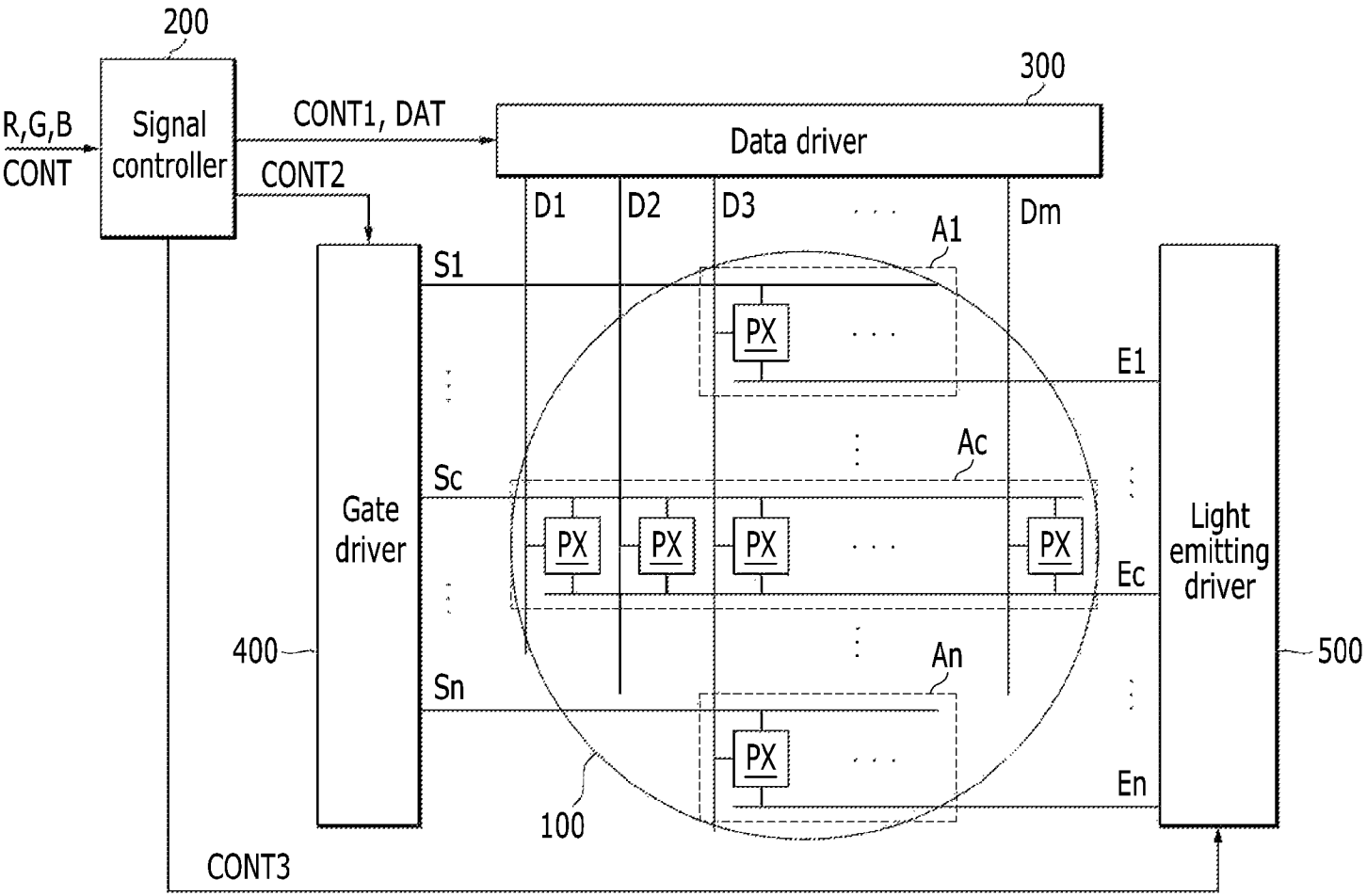
FIG. 1 is a layout view of a display device according to an exemplary embodiment.
Figure 2:
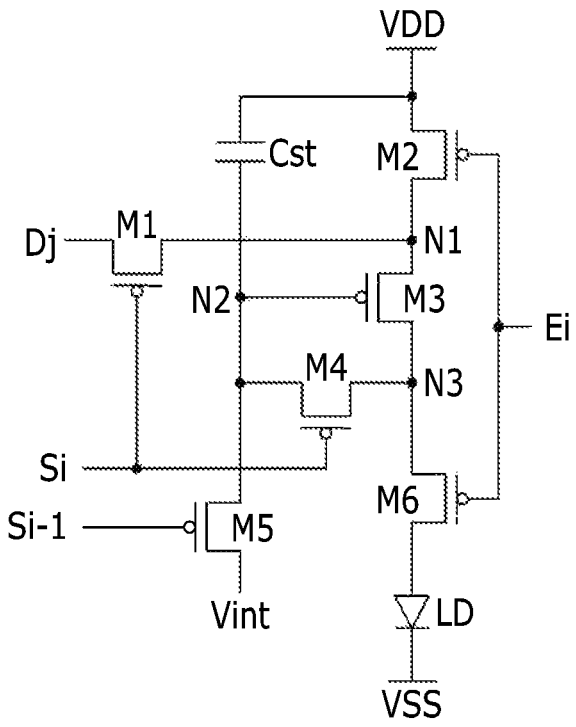
FIG. 2 is an exemplary circuit diagram of one pixel of the display device according to the exemplary embodiment.

FIG. 1 is a layout view of a display device according to an exemplary embodiment. FIG. 2 is an exemplary circuit diagram of one pixel of the display device according to the exemplary embodiment.

First, referring to FIG. 1, the display device includes a display panel 100, a data driver 300 electrically connected thereto, a gate driver 400 and a light-emitting driver 500, and a signal controller 200 for controlling them.

The display panel 100 includes a plurality of data lines D1 to Dm, a plurality of gate lines S1 to Sn, a plurality of light-emitting lines E1 to En, and a plurality of pixels PX that are electrically connected thereto and are substantially arranged in a matrix form. The data lines D1 to Dm substantially extend in a column direction (vertical direction). The gate lines S1 to Sn and the light-emitting lines E1 to En substantially extend in a row direction (horizontal direction) while being insulated from and crossing the data lines D1 to Dm. Each of the data lines D1 to Dm can be electrically connected to all of the pixels PX that are provided in a corresponding pixel column Each of the gate lines S1 to Sn and each of the light-emitting lines E1 to En can be electrically connected to all of the pixels PX that are provided in a corresponding pixel row.

In this case, a set of pixels electrically connected to the respective gate lines in the row direction is referred to as a pixel row, and a set of pixels electrically connected to the respective data lines in a column direction is referred to as a pixel column.

In some embodiments, the display panel 100 does not have a quadrangular (particularly, rectangular) shape, and can have, for example, a circular or oval shape. Thus, the display panel 100 according to the exemplary embodiment can be configured to have different numbers of pixels each pixel row. For example, a pixel row includes p pixels (p is a positive integer), while another pixel row includes q pixels (q is a positive integer and is less than p). The pixel rows respectively having different numbers of pixels have different pixel loads, and thus loads which are managed by circuits of the gate driver can vary based at least in part on the pixel rows.

As shown in FIG. 1, when the display panel 100 has a circular shape, the pixel row positioned at a central region Ac of the display panel 100 substantially includes m pixels, but the pixel row positioned at an upper region A1 or lower region An can include a fewer number of pixels than m. Further, large numbers of pixels are included between the upper region A1 and the central region Ac, but a plurality of regions therebetween can include fewer numbers of pixels than the central region Ac. Similarly, larger numbers of pixels are included between the lower region An and the central region Ac, but a plurality of regions therebetween can include fewer numbers of pixels than the central region Ac.

Only one pixel row is illustrated in each region of FIG. 1 for simplicity, but each region can include a plurality of pixel rows based at least in part on a resolution of the display device. Further, the pixel rows provided in one region can have different numbers of pixels.

In some embodiments, the display panel itself has a substantially quadrangular shape, but the pixels included in the display panel can be formed as other shapes other than a quadrangular shape. For example, a screen, that is, a display area for displaying an image, does not have a substantially quadrangular shape. If the display device includes a plurality of pixel rows having different numbers of pixels, the described technology can be applicable thereto and is not limited to shapes of display panels.

The data driver 300 is electrically connected to the data lines D1 to Dm, and applies, as a data signal, a data voltage corresponding to image signals R, G, and B to the data lines D1 to Dm.

The gate driver 400 is electrically connected to the gate lines S1 to Sn of the display panel 100, and applies a gate signal including a combination of gate-on and gate-off voltages to the gate lines S1 to Sn.

The light-emitting driver 500 is electrically connected to the light-emitting lines E1 to En of the display panel 100, and applies a light-emitting signal including a combination of the gate-on and gate-off voltages to the light-emitting lines E1 to En. The signal controller 200 controls the data driver 300, the gate driver 400, and the light-emitting driver 500. The signal controller 200 receives the image signals R, G, and B, and a control signal CONT thereof from the outside. The control signal CONT can include a horizontal synchronization signal Hsync, a vertical synchronization signal Vsync, a clock signal CLK, a data enable signal DE, and the like. After processing the image signals R, G, and B based at least in part on the control signal CONT to satisfy an operating condition of the display panel 100, the signal controller 200 generates and outputs image data DAT, a data control signal CONT1, a gate control signal CONT2, a light emission control signal CONT3, a clock signal, and the like. The gate control signal CONT2 can include a start pulse vertical signal (STV) for instructing the gate driver 400 to start output of the gate-on voltage, and a clock pulse vertical signal (CPV) for controlling an output time of the gate-on voltage. An output cycle of the start pulse vertical signal (STV) can coincide with one frame or a refresh rate.

Though not illustrated in FIG. 1, the display device can include a plurality of initialization lines electrically connected to the pixels PX, and an initializing driver electrically connected thereto. The initializing driver can apply an initializing signal including a combination of the gate-on and gate-off voltages to the initialization lines based at least in part on an initializing control signal that is outputted from the signal controller 200.

A pixel circuit according to the exemplary embodiment is illustrated in FIG. 2. A data line Dj for transmitting a data signal, gate lines S1 and S(i−1) for transmitting gate signals, a light-emitting line Ei for transmitting a light-emitting signal, and an initialization line Vint for transmitting an initializing signal are electrically connected to one pixel PX. In addition, the pixels PX are supplied with a first power supply voltage VDD and a second power supply voltage VSS.

Each pixel PX includes a light-emitting diode LD and a pixel circuit for controlling the LD. The pixel circuit includes a first switching transistor M1, a second switching transistor M2, a driving transistor M3, a compensation transistor M4, an initialization transistor M5, a light-emitting transistor M6, and a storage capacitor Cst.

The first switching transistor M1 includes a control terminal electrically connected to the gate line Si, an input terminal electrically connected to the data line Dj, and an output terminal electrically connected to a first node N1. The first switching transistor M1 controls the data signal to be transmitted to the driving transistor M3 based at least in part on the gate signal.

The second switching transistor M2 includes a control terminal electrically connected to the light-emitting line Ei, an input terminal electrically connected to the first power supply voltage VDD, and an output terminal electrically connected to the first node N1. The second switching transistor M2 controls the first power supply voltage VDD to be transmitted to the driving transistor M3 based at least in part on the light-emitting signal.

The driving transistor M3 includes a control terminal electrically connected to a second node N2, an input terminal electrically connected to the first node N1, and an output terminal electrically connected to a third node N3. The driving transistor M3 controls the current flowing through the light-emitting diode LD corresponding to the data signal.

The compensation transistor M4 includes a control terminal electrically connected to the gate line Si, an input terminal electrically connected to the third node N3, and an output terminal electrically connected to the second node N2. The compensation transistor M4 can allow the driving transistor M3 to be diode-connected based at least in part on the gate signal such that a threshold voltage of the driving transistor M3 is compensated.

The initialization transistor M5 includes a control terminal electrically connected to the previous gate line S(i−1), an input terminal electrically connected to the initialization line Vint, and an output terminal electrically connected to the second node N2. The initialization transistor M5 can initialize a gate voltage of the driving transistor M3 based at least in part on a gate-on voltage of the previous gate line S(i−1).

The light-emitting transistor M6 includes a control terminal electrically connected to the light-emitting line Ei, an input terminal electrically connected to the third node N3, and an output terminal electrically connected to an anode of the light-emitting diode LD. The light-emitting transistor M6 controls a current flowing through the driving transistor M3 to be transmitted to the light-emitting diode LD based at least in part on the light-emitting signal.

The storage capacitor Cst includes a first electrode electrically connected to the first power supply voltage VDD and a second electrode electrically connected to the second node N2. The storage capacitor Cst stores the gate voltage of the driving transistor M3.

The light-emitting diode LD includes the anode electrically connected to the output terminal of the light-emitting transistor M6, and a cathode electrically connected to the second power supply voltage VSS. The light-emitting diode LD that can be an OLED emits light of varying intensities based at least in part on an output current of the driving transistor M3. Such light-emitting diodes are combined to display an image.

The first switching transistor M1, the second switching transistor M2, the driving transistor M3, the compensation transistor M4, the initialization transistor M5, and the light-emitting transistor M6 can be p-channel field effect transistors (FETs).

In some embodiments, at least one of the transistors M1 to M6 can be an n-channel FET.

Now, a pixel driving in which all of the transistors M1 to M6 included in the pixel circuit are p-channel FETs will be described as an example.

When a gate signal of the previous gate line S(i−1) is applied as the gate-on voltage, the gate signal of the corresponding gate line S1 and a light-emitting signal of the light-emitting line Ei can be applied as the gate-off voltage. Then, the first switching transistor M1, the second switching transistor M2, the compensation transistor M4, and the light-emitting transistor M6 are turned off, and only the initialization transistor M5 is turned on. Accordingly, the first power supply voltage VDD is applied to the first electrode of the storage capacitor Cst, and an initialization voltage is applied to the second electrode thereof. The data voltage previously stored in the storage capacitor Cst, that is, the gate voltage of the driving transistor M3, is initialized.

Next, the gate signal of the previous gate line S(i−1) is applied as the gate-off voltage, the gate signal of the corresponding gate line S1 is applied as the gate-on voltage, and the light-emitting signal of the light-emitting line Ei can be applied as the gate-off voltage. At this point, the data voltage is applied to the data line Dj. The second switching transistor M2, the initialization transistor M5, and the light-emitting transistor M6 are turned off, and the first switching transistor M1 and the compensation transistor M4 are turned on. Accordingly, the control terminal of the driving transistor M3 is electrically connected to the output terminal of the compensation transistor M4 and the output terminal of the driving transistor M3 is electrically connected to the input terminal of the compensation transistor M4, thereby diode-connecting the driving transistor M3. Since the driving transistor M3 is diode-connected, a gate voltage (Vdata−Vth), where a threshold voltage Vth of the driving transistor M3 is subtracted from the data voltage Vdata, is applied to the gate electrode of the driving transistor M3. The gate voltage (Vdata−Vth) is stored in the storage capacitor Cst.

Next, the gate signal of the previous gate line S(i−1) and the gate signal of the corresponding gate line S1 can be applied as the gate-off voltage. The light-emitting signal of the light-emitting line Ei can be applied as the gate-on voltage. Thus, the first switching transistor M1, the compensation transistor M4, and the initialization transistor M5 are turned off, and the second switching transistor M2 and the light-emitting transistor M6 are turned on. Accordingly, the first power supply voltage VDD is transferred to the driving transistor M3 through the second switching transistor M2, the driving transistor M3 allows a gate voltage (Vdata−Vth)-dependent current to flow to the light-emitting diode LD, and the light-emitting diode LD emits light of a predetermined luminance based at least in part on the amount of current.

Now, the gate driver 400 of the display device will be described in detail with reference to FIGS. 3 to 5.

Figure 3:
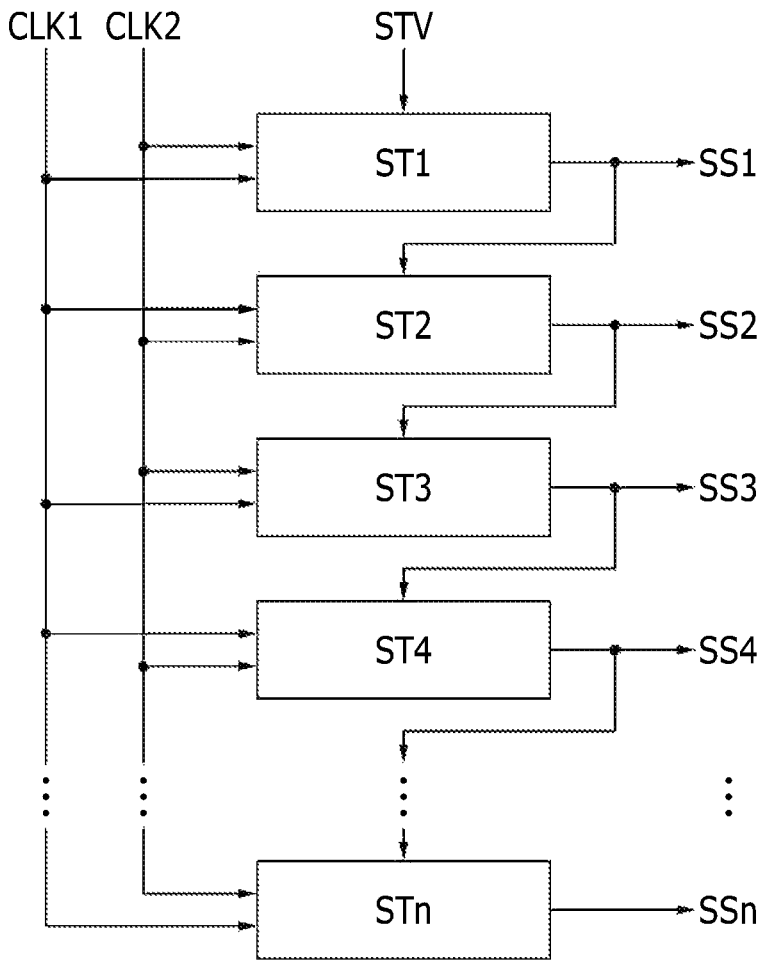
FIG. 3 is a block diagram of a gate driver according to the exemplary embodiment.

FIG. 3 is a block diagram of a gate driver according to the exemplary embodiment. FIG. 4 is an exemplary circuit diagram of one stage of a shift register for the gate driver of FIG. 3. FIG. 5 is a signal waveform diagram of the gate driver of FIG. 3.

Referring to FIG. 3, the gate driver 400 includes a shift register including a plurality of stages ST1 to STn that are sequentially arranged in the row direction and are respectively electrically connected to the gate lines S1 to Sn.

The shift register receives the start pulse vertical signal (STV) and the first and second clock signals CLK1 and CKL2 that are supplied while being sequentially delayed in phase. The first stage ST1 delays a phase of the start pulse vertical signal (STV) supplied to itself by one clock cycle in response to the first and second clock signals CLK1 and CLK2, and outputs an output signal SS1 corresponding to the gate signal. The second to n-th stages ST2 to STn delay phases of the output signals SS1 to SS(n−1)) of the previous stages ST1 to ST(n−1)) supplied to themselves by one clock cycle in response to the first and second clock signals CLK1 and CLK2, and output output signals SS2 to SSn. Accordingly, the respective stages ST1 to STn generate the output signals SS1-SSn that are sequentially delayed in phase, and the output signals SS1 to SSn are sequentially applied to the gate lines S1 to Sn as the gate signals.

Meanwhile, the shift register driven by the two clock signals CLK1 and CLK2 that are sequentially delayed in phase are illustrated in FIG. 3, but the shift register can be driven by three or more clock signals that are sequentially delayed in phase.

When the gate lines for which numbers of pixels electrically connected to the gate lines S1 to Sn are different are present, that is, numbers of pixels are different based at least in part on the pixel rows, the loads that are electrically connected to the corresponding gate lines to be managed by outputs of the stages can vary based at least in part on the pixel rows. Thus, when these stages are designed to have the same buffer size, an output signal characteristic of the stages, particularly, a difference between a rising time and a falling time, is generated due to a load difference between the pixel rows. Accordingly, between the pixel rows having the different numbers of pixels, a time delay can occur between an applied time of the data voltage and/or a light-emitting time of the light-emitting diode. According to at least one disclosed embodiment, the gate driver, particularly, the stages, are designed such that such a delay is eliminated or minimized, and a description thereof will be given later.

Figure 4:
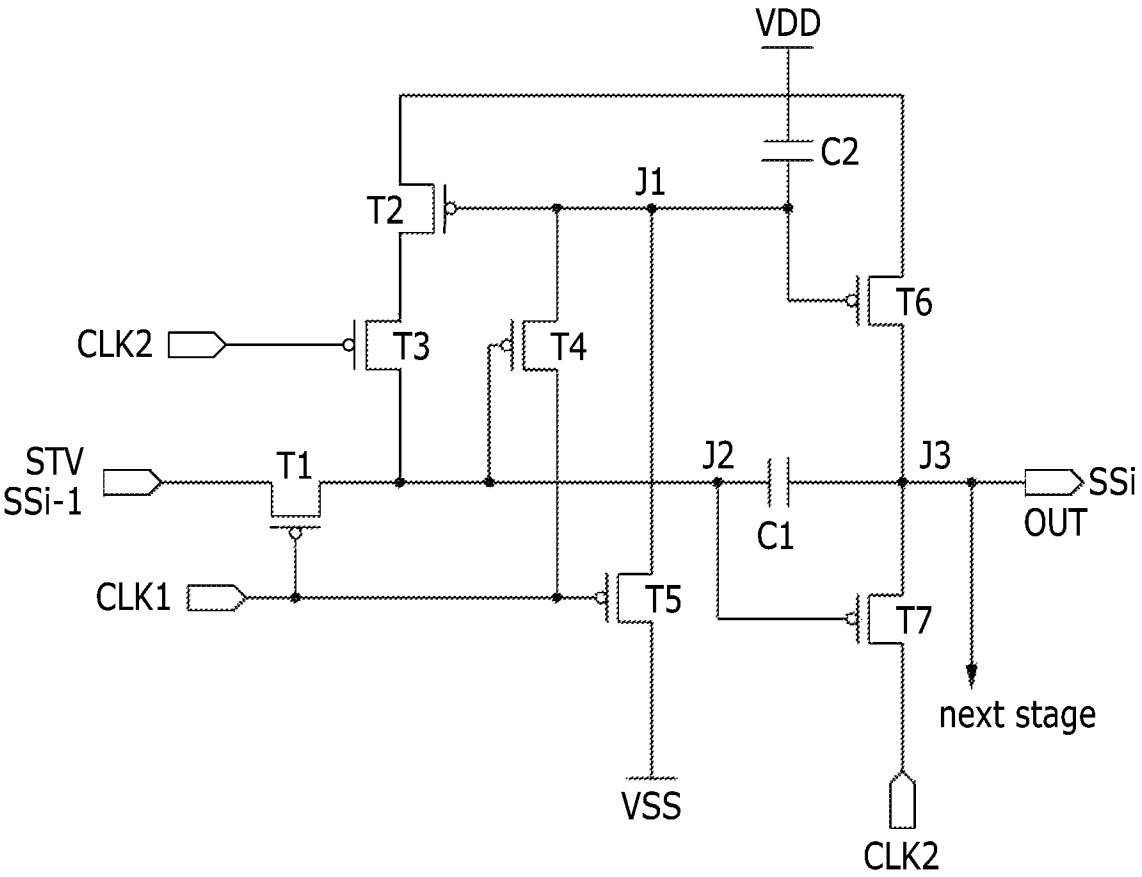
FIG. 4 is an exemplary circuit diagram of one stage of a shift register for the gate driver of FIG. 3.

Referring to FIG. 4, one stage STi includes first to seventh transistors T1 to T7 and first and second capacitors C1 and C2. The first to seventh transistors T1 to T7 are all illustrated as being p-channel FETs, but in some exemplary embodiments, at least one of them can be an n-channel FET.

The first to fourth transistors T1 to T4 control voltage levels of a first node J1 and a second node J2 to be high or low in response to the start pulse vertical signal (STV) or previous stage output signal SS(i−1) and the first and second clock signals CLK1 and CLK2. Thus, the first to fourth transistors T1 to T4 can be referred to as voltage level controllers.

The first transistor T1 is electrically connected between the start pulse vertical signal (STV) or input terminal of the previous stage output signal SS(i−1) and the second node J2, and a control terminal of the first transistor T1 is electrically connected to an input terminal of the first clock signal CLK1. The first transistor T1 is turned on when the first clock signal CLK1 at the low level is provided to its control terminal, and provides the start pulse vertical signal (STV) or previous stage output signal SS(i−1) to the second node J2.

The second transistor T2 is electrically connected between the input terminal of the first power supply voltage VDD, which is a high level voltage, and the third transistor T3. A control terminal of the second transistor T2 is electrically connected to the first node J1.

The third transistor T3 is electrically connected between the second transistor T2 and the second node J2, and a control terminal of the third transistor T3 is electrically connected to an input terminal of the second clock signal CLK2. The third transistor T3 is turned on when the second clock signal CLK2 at the low level is provided to its control terminal, and in this case, the first power supply voltage VDD is electrically connected to the second node J2 when the second transistor T2 is turned on.

The fourth transistor T4 is electrically connected between the first node J1 and the input terminal of the first clock signal CLK1. A control terminal of the fourth transistor T4 is electrically connected to the second node J2. The fourth transistor T4 is turned on when the voltage level of the second node J2 decreases to a low level under a predetermined level, and electrically connects the first clock signal CLK1 to the first node J1.

The fifth transistor T5 is electrically connected between the first node J1 and an input terminal of the second power supply voltage VSS, which is a low level voltage. A control terminal of the fifth transistor T5 is electrically connected to the input terminal of the first clock signal CLK1. The fifth transistor T5 is turned on when receiving the first clock signal CLK1 at the low level to electrically connect the first node J1 to the second power supply voltage VSS.

The sixth transistor T6 is electrically connected between the first power supply voltage VDD and a third node J3. A control terminal of the sixth transistor T6 is electrically connected to the first node J1. The sixth transistor T6 is turned on when a voltage level of the first node J1 is low (i.e., a voltage of the first node J1 is lower than that of an input terminal of the sixth transistor T6). The sixth transistor electrically connects the first power supply voltage VDD to an output terminal OUT of the stage STi. The seventh transistor T7 is a core part of the stage STi to generate and output the gate-on voltage. The seventh transistor T7 can be referred to as an output transistor since it outputs the gate-on voltage of the stage STi. The seventh transistor T7 is electrically connected between the third node J3 and the input terminal of the second clock signal CLK2, and a control terminal of the seventh transistor T7 is electrically connected to the second node J2. The third node J3 is substantially identical to the output terminal OUT of stage STi. The seventh transistor T7 is turned on when the voltage level of the second node J2 is low, and electrically connects the output terminal OUT of the stage STi to the input terminal of second clock signal CLK2. That is, when the seventh transistor T7 is turned on, the voltage level of an output signal SSi of the stage is substantially identical to the voltage level of the second clock signal CLK2.

Since the second clock signal CLK2 is output as the output signal SS1 of the stage, which is the gate-on voltage, through the seventh transistor T7, characteristics of the output signal SS1 are affected by the seventh transistor T7. Since resistance of the seventh transistor T7 decreases as a channel width of the seventh transistor T7 increases, output characteristics of the second clock signal CLK2 can be further improved.

The output characteristics can be rising and falling characteristics of the output signal SSi. As the channel width of the seventh transistor T7 increases, rising and falling speeds of the output signal SS1 become faster. On the contrary, as the channel width of the seventh transistor T7 decreases, delay increases in a waveform of the output signal SSi. The seventh transistor T7 is referred to as a buffer transistor, and the channel width of the seventh transistor T7 is referred to as a buffer size.

In some embodiments, the seventh transistor T7 of the stage electrically connected to the pixel row including a relatively small number of pixels (e.g., the pixel row provided in the upper region A1 of FIG. 1) has a smaller channel width than the seventh transistor T7 of the stage electrically connected to the pixel row including a relatively large number of pixels (e.g., the pixel row provided in the central region Ac of FIG. 1). For example, when the channel width of the seventh transistor T7 of the stage electrically connected to the pixel row of the central region Ac is designed to be about 80 μm, the channel widths of the seventh transistors T7 of the stage electrically connected to the pixel rows of the upper and lower regions A1 and An are designed to be about 40 μm. In addition, the seventh transistor T7 of the stage electrically connected to the pixel rows of regions A2 to Ac−1 between the central region Ac and the upper region A1 can be designed such that its channel width decreases from about 80 μm to about 40 μm closer to the upper region A1 from the central region Ac. Similarly, the seventh transistor T7 of the stage electrically connected to the pixel rows of regions Ac+1 to An−1) between the central region Ac and the lower region An can be designed such that its channel width decreases from about 80 μm to about 40 μm closer to the lower region An from the central region Ac. In this way, the seventh transistor T7 for each stage can be designed to have differences in its channel width, and a degree of the differences can be designed such that a deviation between the output signals SS1 for the respective pixel rows are decreased or minimized. For example, the channel width of the transistor T7 of each stage is designed such that the rising and falling times of the output signal SS1 for each stage are similar or substantially identical to each other.

The seventh transistor T7 having the different channel widths between the stages can be designed by varying the number of transistors having substantially the same size or by varying a size of one or more transistors. Regarding the former case, for example, ten transistors having a channel width and a channel length of a 5×5 size are connected in parallel to make a transistor having a 50×5 size, and two transistors are connected in parallel to make a transistor having a 10×5 size.

The first capacitor C1 is electrically connected between the second node J2 and the third node J3. The first capacitor C1 stabilizes an operation of the seventh transistor T7 by storing a predetermined voltage corresponding to a potential difference between its two electrodes.

The second capacitor C2 is electrically connected between the first power supply voltage VDD and the first node J1. The second capacitor C2 serves to reduce a variation of the voltage that is applied to the first power supply voltage VDD or first node J1.

Meanwhile, in the stage STi illustrated in FIG. 4, the first clock signal CLK1 is provided to the control terminals of the first and fifth transistors T1 and T5. The second clock signal CLK2 is provided to the control terminal of the third transistor T3 and an input terminal of seventh transistor T7, but the first and second clock signals CLK1 and CLK2 can be provided to the respective stages while being shifted by one clock cycle at every stage. For example, in the next stage ST(i+1) of the stage STi that is illustrated in FIG. 4, the second clock signal CLK2 is provided to the control terminals of the first and fifth transistors T1 and T5, and the first clock signal CLK1 is provided to the control terminal of third transistor T3 and the input terminal of seventh transistor T7.

The shift register including the stage described above can be integrated on a substrate along with the pixel circuit. In this case, there is no need for manufacturing an additional gate driving chip, which results in a reduced cost. However, the shift register can be embedded in a chip and the like such that it is mounted on the substrate.

Now, an operation of the stage illustrated in FIG. 4 will be described with reference to the signal waveform illustrated in FIG. 5. For convenience, factors such as a threshold voltage of the transistor and the like will not be discussed.

Figure 5:
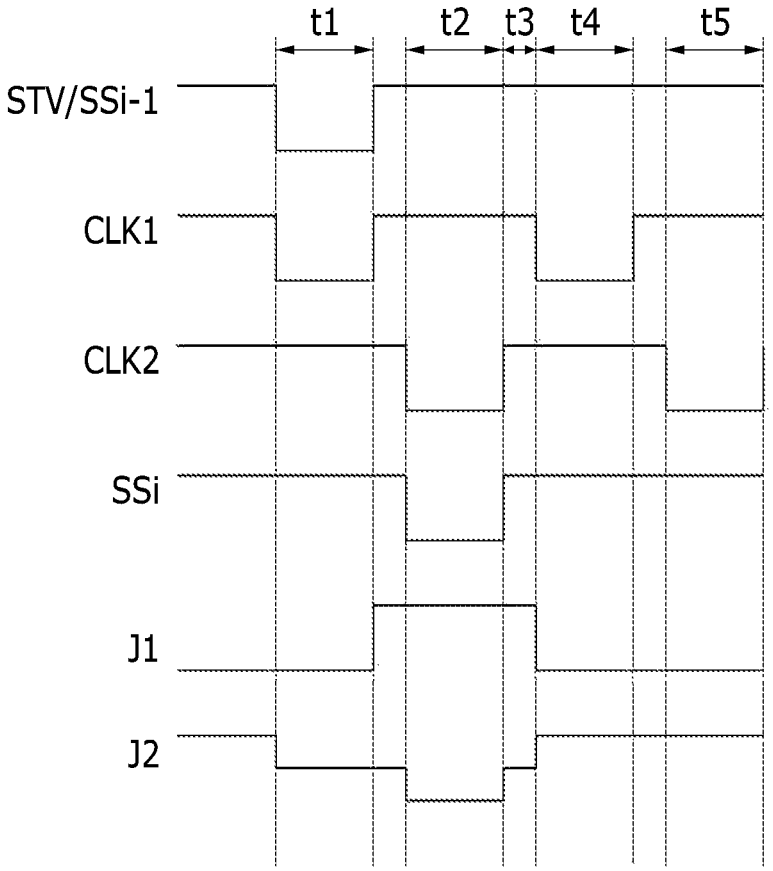
FIG. 5 is a signal waveform diagram of the gate driver of FIG. 3.

Referring to FIG. 5, the start pulse vertical signal (STV) at the low level or previous stage output signal SS(i−1) is provided first to the input terminal of the first transistor T1 for a t1 period. In addition, the first clock signal CLK1 at the low level is provided to the control terminals of the first and fifth transistors T1 and T5. The second clock signal CLK2 at the high level is provided to the control terminal of the third transistor T3 and the input terminal of the seventh transistor T7. In this case, the first clock signal CLK1 and the second clock signal CLK2 are signals having waveforms that are sequentially delayed in phase. Accordingly, the first transistor T1 and the fifth transistor T5 are turned on, and the third transistor T3 is turned off.

When the fifth transistor T5 is turned on, the second power supply voltage VSS is transferred to the first node J1. Thus, the voltage at the low level is applied to the first node J1 for the t1 period. In this case, the sixth transistor T6 is turned on by the voltage of the first node J1 at the low level to supply the first power supply voltage VDD to the output terminal OUT of the stage STi. Accordingly, the output signal SS1 outputted from the stage STi is maintained at the high level for the t1 period. The start pulse vertical signal (STV) at the low level or previous stage output signal SS(i−1) is applied to the second node J2, and a voltage for turning on the seventh transistor T7 is charged in the first capacitor C1.

Next, the start pulse vertical signal (STV) at the high level or previous stage output signal SS(i−1) is provided to the input terminal of the first transistor T1 for a t2 period. In addition, the first clock signal CLK1 at the high level is provided to the control terminals of the first and fifth transistors T1 and T5. The second clock signal CLK2 at the low level is provided to the control terminal of the third transistor T3 and the input terminal of the seventh transistor T7. Then, the first and fifth transistors T1 and T5 are turned off in response to the first clock signal CLK1 at the high level. In addition, the seventh transistor T7 maintains a turned-on state since the voltage for turning on the seventh transistor T7 is charged in the first capacitor C1 in the previous period, that is, the t1 period. Accordingly, the waveform of the output signal SS1 of the stage STi follows a waveform of the second clock signal CLK2. That is, the output signal SS1 of the stage STi has the low level in the t2 period.

As the second clock signal CLK2 changes from the high level to the low level in the t2 period, the second node J2 has a lower level than the level in the t1 period due to a coupling effect of a gate-source capacitor of the seventh transistor T7 (not shown). Accordingly, the fourth transistor T4 is turned on and thus the first node J1 has the high level.

Next, the start pulse vertical signal (STV) at the high level or previous stage output signal SS(i−1) is provided to the input terminal of the first transistor T1 for a t3 period. The clock signal CLK1 at the high level is provided to the control terminals of the first and fifth transistors T1 and T5. The second clock signal CLK2 at the high level is provided to the control terminal of the third transistor T3 and the input terminal of the seventh transistor T7. Then, the first, third, and fifth transistor T1, T3, and T5 maintain a turned-off state in response to the start pulse vertical signal (STV) at the high level or the previous stage output signal SS(i−1) and the first and second clock signals CLK1 and CLK. The seventh transistor T7 maintains the turned-on state by the first capacitor C1, and accordingly, the output signal SS1 of the stage STi follows the waveform of the second clock signal CLK2 to have the high level. In this case, due to the coupling effect of the gate-source capacitor of the seventh transistor T7, the second node J2 increases from the low level in the t2 period by a predetermined value to have a level that is similar to or the same as the level in the t1 period. Accordingly, as the fourth transistor T4 maintains the turned-on state, the first node J1 is maintained at the high level.

In the following periods, since the start pulse vertical signal (STV) or previous stage output signal SS(i−1) and the second node J2 maintain the high level, the output signal SS1 of the stage STi also maintains the high level.

By the driving method described above, the stage STi of the shift register according to the exemplary embodiment delays the previous stage output signal SS(i−1) or start pulse vertical signal (STV) received therefrom by one clock cycle to output it to the output terminal OUT in response to the first and second clock signals CLK1 and CLK2.

Figure 6:
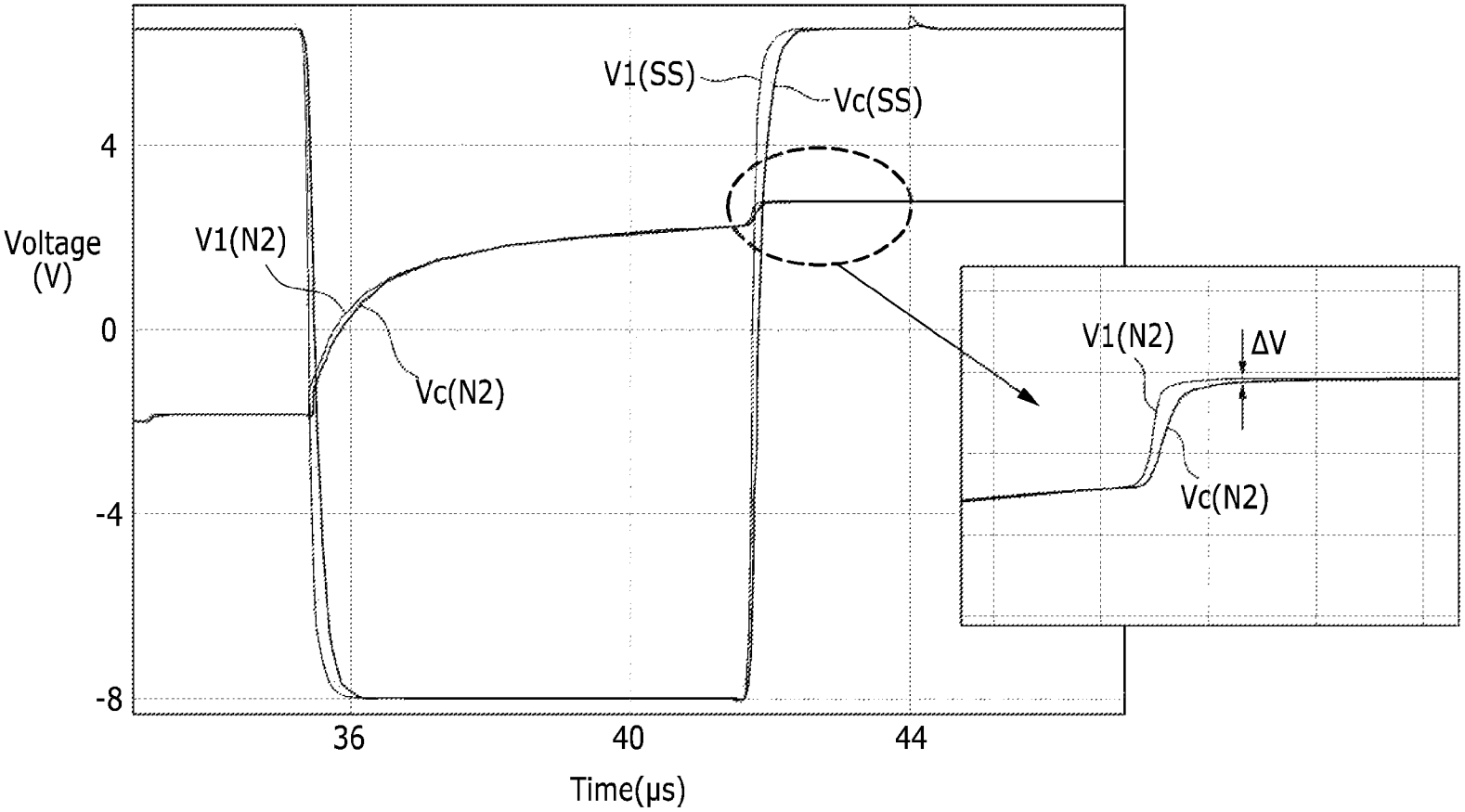
FIGS. 6 and 7 are graphs for representing a relationship between an output terminal voltage of the stage of FIG. 4 and a gate voltage of a driving transistor of the pixel of FIG. 2.
Figure 7:
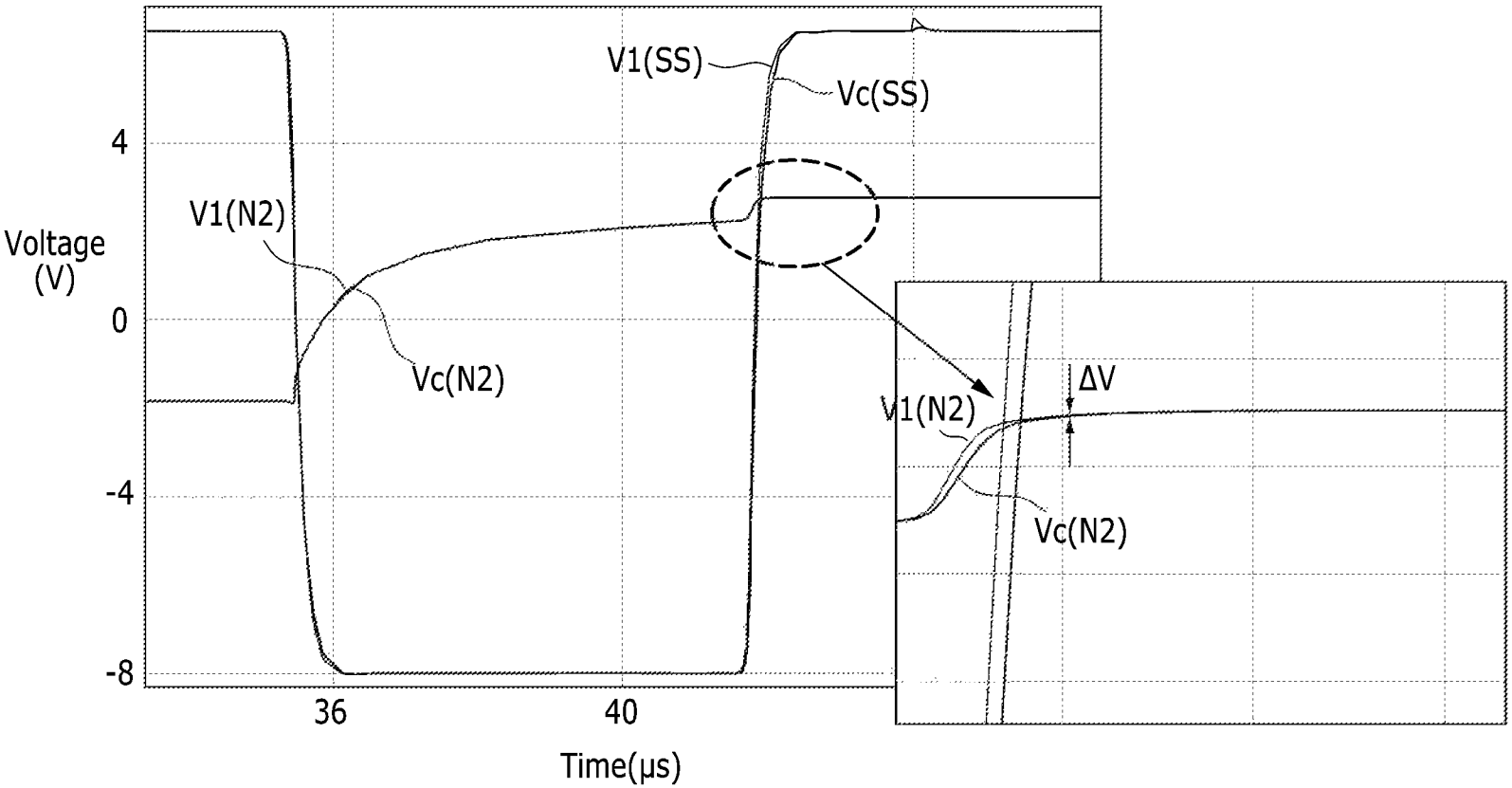

FIGS. 6 and 7 are graphs representing a relationship between an output terminal voltage of the stage of FIG. 4 and a gate voltage of a driving transistor of the pixel of FIG. 2.

FIG. 6 illustrates a case in which the stage having substantially the same channel width of the T7 transistor (m=10, where m is the number of transistors forming the T7 transistor) is electrically connected to all of the pixel rows in the upper region A1 illustrated in FIG. 1 and in the central region Ac, and the T7 transistor is formed by ten transistors having substantially the same size and that are connected in parallel. FIG. 7 illustrates a case in which the stage (m=10) of which a channel width of the T7 transistor is substantially the same as that of FIG. 6 is electrically connected to the pixel row in the central region Ac, but the stage (m=1) of which a channel width of the T7 transistor is about one tenth of that of FIG. 6 is electrically connected to the pixel row in the upper region A1.

Referring to FIG. 6, the output signal V1(SS) of the stage electrically connected to the pixel row of the upper region A1 has a shorter rising time and a shorter falling time than those of the output signal Vc(SS) of the stage that is electrically connected to the pixel row of the central region Ac. Thus, even if substantially the same data voltage is applied to the pixels of the upper region A1 and the central region Ac, voltages V1(N2) and Vc(N2) of the second node N2, which is the control terminal of the driving transistor M3, have a difference ΔV between the pixels provided in the two regions A1 and Ac in the pixel circuit of FIG. 2. Accordingly, amounts of currents flowing through the light-emitting diodes LD of the pixels of the respective regions vary, thereby generating a luminance difference between the upper region A1 and the central region Ac.

Table 1 below shows a simulation result of the currents flowing through the light-emitting diodes LD of the pixels in the upper region A1 and the central region Ac. It can be seen that the amount of current through the light-emitting diode in the central region Ac is smaller by about −1.71% to about −12.58% than that flowing through the light-emitting diode in the upper region A1 depending on grays. This means that the luminance of the central region Ac is lower than that of the upper region A1.

TABLE 1

| Gray | 255 | 127 | 87 | 31 |
|---|---|---|---|---|
| A1 | 1.87E-08 | 4.05E-09 | 1.74E-09 | 1.93E-10 |
| Ac | 1.84E-08 | 3.94E-09 | 1.61E-09 | 1.71E-10 |
| Difference in amount of current (%) | -1.71 | -2.82 | -8.13 | -12.58 |

Referring to FIG. 7, the output signal V1(SS) of the stage electrically connected to the pixel row of the upper region A1 and the output signal Vc(SS) of the stage electrically connected to the pixel row of the central region Ac have a rising time and a falling time that are nearly identical to each other. Accordingly, when substantially the same data voltage is applied to the pixels of the upper region A1 and the central region Ac, the difference ΔV between the voltages V1(N2) and Vc(N2) of the second node N2 significantly decreases for the two regions A1 and Ac. As can be seen in Table 2 showing the simulation result of the currents flowing through the light-emitting diodes of the pixels in the upper region A1 and the central region Ac, differences in the amounts of currents between the two regions based at least in part on the grays are improved.

TABLE 2

| Gray | 255 | 127 | 87 | 31 |
|---|---|---|---|---|
| A1 | 1.86E-08 | 3.99E-09 | 1.64E-09 | 1.76E-10 |
| Ac | 1.84E-08 | 3.93E-09 | 1.61E-09 | 1.71E-10 |
| difference in amount of current (%) | -0.89 | -1.45 | -2.00 | -2.98 |

While the inventive technology has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display panel including a plurality of gate lines and a plurality of pixels electrically connected to the gate lines, wherein the pixels comprise a first pixel row and a second pixel row having a fewer number of pixels than the first pixel row; and a gate driver including a plurality of stages each configured to output a gate signal to the respective gate line, wherein the gate lines comprise first and second gate lines respectively connected to the first and second pixel rows, wherein the stages comprise first and second stages respectively connected to the first and second gate lines, wherein each stage includes an output transistor electrically connected between an input terminal of a clock signal and an output terminal of the stage, wherein the output transistor is configured to output the gate signal, and wherein the channel width of the output transistor of the first stage is greater than that of the output transistor of the second stage.

2. The display device of claim 1, wherein the output transistor includes an input terminal electrically connected to a second clock signal input terminal, an output terminal electrically connected to an output terminal of the stage, and a control terminal electrically connected to a first node.

3. The display device of claim 2, wherein the difference between the channel widths of the output transistors corresponds to a value configured to reduce a deviation between characteristics of a gate signal applied to the first pixel row and characteristics of a gate signal applied to the second pixel row.

4. The display device of claim 3, wherein the characteristics of the gate signal include a falling time and a rising time of a gate-on voltage.

5. The display device of claim 2, wherein each of stages is configured to receive a start pulse vertical signal or a previous stage output signal, first and second clock signals, and first and second power supply voltages.

6. The display device of claim 5, wherein the first and second clock signals have waveforms that are sequentially delayed in phase.

7. The display device of claim 2, wherein each stage further includes a first and second nodes and a voltage level controller configured to control voltage levels of the first and second nodes to have high and low levels.

8. The display device of claim 7, wherein:

the voltage level controller includes T1, T2, T3, and T4 transistors;

the T1 transistor is electrically connected between an input terminal of the start pulse vertical signal or a previous stage output signal and the first node;

the T2 transistor is electrically connected between the first power supply voltage and the T3 transistor;

the T3 transistor is electrically connected between the T2 transistor and the first node;

the T4 transistor is electrically connected between the second node and a first clock signal input terminal; and control terminals of the T1, T2, T3, and T4 transistors are respectively electrically connected to the first clock signal input terminal, the second node, the second clock signal input terminal, and the first node.

9. The display device of claim 7, wherein each stage further includes a T5 transistor, which is electrically connected between a second power supply voltage and the second node with its control terminal electrically connected to a first clock signal input terminal.

10. The display device of claim 9, wherein each stage further includes a T6 transistor, which is electrically connected between a first power supply voltage and an output terminal of the stage with its control terminal electrically connected to the second terminal.

11. The display device of claim 10, wherein each stage further includes a first capacitor that is electrically connected between the first node and the output terminal of the stage.

12. The display device of claim 11, wherein each stage further includes a second capacitor that is electrically connected between the second node and the first power supply voltage.

13. The display device of claim 1, wherein the display panel or a display area of the display panel has a non-quadrangular shape.

14. The display device of claim 13, wherein the display panel or the display area thereof is substantially circular or oval.

15. The display device of claim 1, wherein the gate driver is integrated into the display panel.

16. A display device, comprising:

a display panel including a plurality of gate lines and a plurality of pixels electrically connected to the gate lines; and a gate driver including a plurality of stages each including an output transistor configured to output a gate signal to the respective gate line, wherein the stages comprise first and second stages, wherein the channel widths of the output transistors of the first and second stages are different, wherein the output transistor of each stage is electrically connected between an input terminal of a clock signal and an output terminal of the stage, and wherein the output transistor includes an input terminal electrically connected to a second clock signal input terminal, an output terminal electrically connected to an output terminal of the stage, and a control terminal electrically connected to a first node.

* * * * *